United States Patent [19]

Kiyono et al.

[11] 4,123,741

[45] Oct. 31, 1978

[54] RESISTANCE ELEMENT FOR VARIABLE RESISTORS

[75] Inventors: Tetsuhiro Kiyono; Moritoshi Nakamura, both of Miyagi; Jun Nakanowatari, Furukawa, all of Japan

[73] Assignee: Alps Electric Co., Ltd., Japan

[21] Appl. No.: 810,082

[22] Filed: Jun. 27, 1977

[30] Foreign Application Priority Data

Jul. 1, 1976 [JP] Japan ..... 51-86980

[51] Int. Cl.[2] ..... H01C 10/30

[52] U.S. Cl. ..... 338/121; 338/138; 338/217; 338/128; 338/195; 338/183; 338/287; 338/293; 338/307; 338/308; 338/320; 338/292; 427/103

[58] Field of Search ..... 338/118, 120, 121-123, 338/125-128, 133, 160, 138, 162, 217, 183, 139, 194, 195, 202, 283, 285, 287, 294, 292, 293, 307-309, 314, 320, 333, 334; 29/610, 621; 427/103

[56] References Cited

U.S. PATENT DOCUMENTS

| | | | |
|---|---|---|---|
| 1,755,314 | 4/1930 | Carter | 338/218 |
| 1,767,715 | 6/1930 | Stoekle | 338/195 X |
| 2,261,667 | 11/1941 | Stroszeck | 338/195 |
| 2,799,756 | 7/1957 | Graham | 338/122 |
| 3,602,861 | 8/1971 | Tweed et al. | 338/162 X |
| 3,864,545 | 2/1975 | Schafer et al. | 338/195 X |
| 4,039,994 | 8/1977 | Ward | 338/162 X |

*Primary Examiner*—C. L. Albritton

*Attorney, Agent, or Firm*—Guy W. Shoup; Gerard F. Dunne

[57] ABSTRACT

A resistance element for obtaining a continuous and linear output characteristic is obtained by the combination of a zig-zag resistance element and a resistance film of higher resistivity disposed thereover.

4 Claims, 5 Drawing Figures

RESISTANCE ELEMENT FOR VARIABLE RESISTORS

BACKGROUND OF THE INVENTION

1. Field of the Invention

This invention relates to resistance elements for variable resistors, and more particularly, to zig-zag type resistance elements formed on insulating base plates by means of printing or by vacuum evaporation.

2. Description of the Prior Art

As illustrated in FIG. 1, a resistance element 3 for a known form of conventional variable resistor is generally formed in zig-zag fashion within the sliding range of a slider in order to be able to obtain a large variation ratio of resistance value. In such resistors, the slider is moved linearly along the center portion of the resistance element 3, whereby the resistor will exhibit a resistance variation and, when used in a potentiometer, an output voltage variation represented by a graph that varies in the form of a step, as shown by a full line in FIG. 2, thus resulting in the degradation of the resolution of the output voltages. In addition, the sliding motion of the slider is not smooth because the slider does not move continuously over the surface of resistance element 3, thus also resulting in the generation of noises and the shortening of the life of the resistor.

SUMMARY OF THE INVENTION

It is therefore an object of the present invention to provide an improved variable resistor without defects mentioned previously.

BRIEF DESCRIPTION OF THE DRAWINGS

The above mentioned and other features and objects of the present invention will become more apparent by reference to the following description taken in conjunction with the accompanying drawings, in which.

DESCRIPTION OF THE PREFERRED EMBODIMENT

Figure 1:
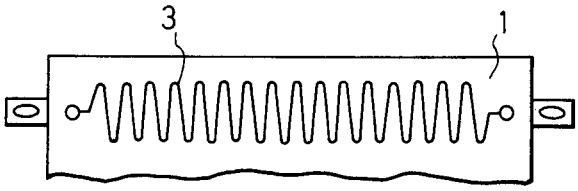
Fig. 1 PRIOR ART
FIG. 1 shows a plan view of a resistance element for a known type of conventional variable resistor.
Figure 2:
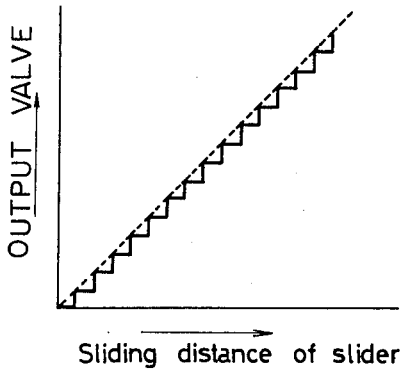
FIG. 2 is a graph showing variation in the characteristics of a resistance element.
Figure 3:
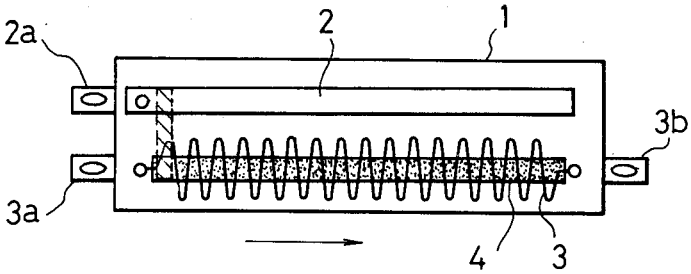
FIG. 3 shows a plan view of one of the embodiments of a variable resistor according to the present invention.

Referring now to FIG. 3, an insulating base plate 1 has formed thereon an electrical conductor 2 made, for example, of silver paste and connected at one end thereof to an intermediate terminal 2*a*. A resistance element 3 is arranged in zig-zag fashion on the base plate and is connected to terminals 3*a* and 3*b* at respective ends. By this arrangement, the resistance element 3 can be formed in parallel with the conductor 2 by a printing technique or by vacuum evaporation. A resistance film 4 made of carbon resin or the like is formed continusouly along the center of the resistance element 3, and a slider is movable over the resistance film 4 while contacting therewith. The resistivity of the resistance film 4 is selected so as to be at a higher value as compared with that of the resistance element 3. Therefore, the sliding of the slider, in the direction of the arrow shown in FIG. 3, over the resistance film 4 attains the same effects as if the slider were to continuously slide in a zig-zag fashion along the resistance element 3. As the result, the variable resistor, when used as a potentiometer, will show a continuous and linear variation in output voltage represented by the graph shown by a dotted line in FIG. 2, thus resulting in linear output voltages having a high resolution. In addition, the generation of noises can also greatly be reduced because the slider is moved along the continuous surface of the resistance film 4.

Figure 4:
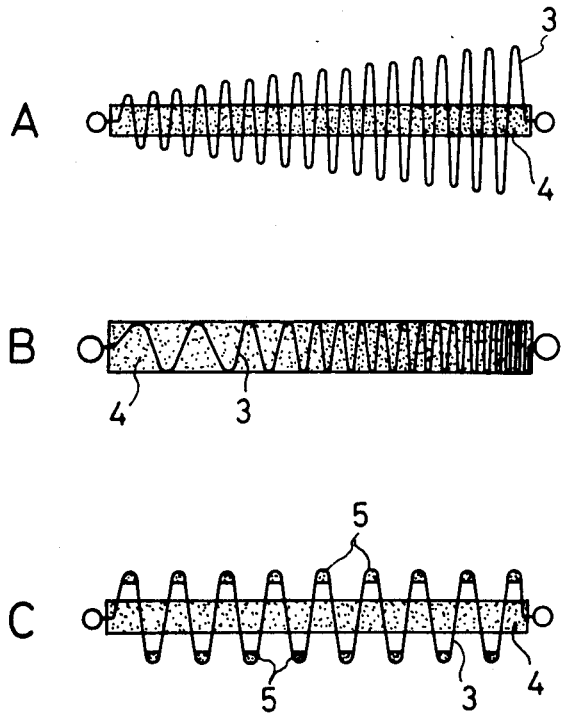
FIGS. 4*a*, 4*b* and 4*c* show respective plan views for three other embodiments of the present invention.
Figure 5:
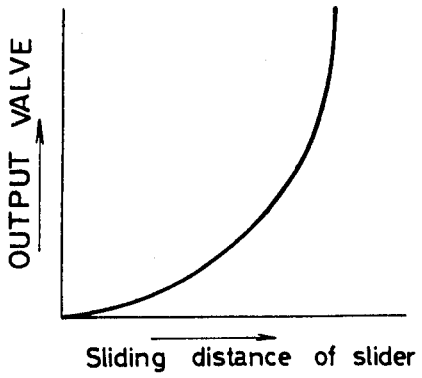
FIG. 5 is a graph showing a variation characteristic obtained by resistors constructed according to the present invention.

FIGS. 4*a*, 4*b* and 4*c* show other embodiments of the present invention. In FIG. 4*a*, the resistance element 3 is so arranged that the width of meandering or back-and-forth portion thereof becomes progressively wider in one direction. In FIG. 4*b*, the resistance element 3 is so arranged that the pitch of the meandering portion becomes progressively narrower in one direction, i.e. the number of back-and-forth portions per unit length increase in a longitudinal direction. The output variation characteristics for the resistance element 3 of FIG. 4*a* or FIG. 4*b* is illustrated in FIG. 5. FIG. 4*c* shows still another embodiment of the present invention, wherein the value of resistance can be adjusted by adding a resistance member 5 for trimming each folded or turned back portion of the resistance element 3 formed in zig-zag fashion by scraping a part of the resistance member 5 by use of an appropriate method.

As described above, a resistance element according to this invention is constructed by the combination of a zig-zag resistance element which is disposed on an insulating base plate and connected to terminals at respective ends thereof, a resistance film made of carbon resin having a resistivity as described above and associated with the resistance element 3, and a slider which moves over the resistance film. Since the resistance film has a resistivity higher than that of the resistance element, the rectilinear motion of the slider produces a voltage output corresponding to a continuous zig-zag motion of the slider along the zig-zag path of the resistance element, thereby attaining linear output voltages of high resolution for the variable resistor. Besides, since the slider is always moved on a flat surface formed by the resistance film, the variable resistor offers various outstanding features in that the generation of noises can be prevented, abrasion of the slider or resistance element is less and sliding sensitivity is greatly improved.

Although the present invention has been explained in connection with the resistance element for a longitudinally sliding variable resistor, it can be, of course, applied also to a resistance element for a rotary-type variable resistor.

What is claimed is:

1. A variable resistor comprising:

an elongate, substantially planar base plate formed from an electrically insulating material;

a resistance element formed in a zig-zag pattern on a surface of said base plate by depositing thereon a material having a predetermined resistivity;

an elongate resistance film formed over said resistance element and extending along the central portion thereof, said resistance film being formed from a material having a resistivity higher than that of the material forming said resistance element; and a slider having a portion thereof in sliding contact with said resistance film and adapted to be moved therealong.

2. A variable resistor according to claim 1, said resistance element being formed in a zig-zag pattern of varying width.

3. A variable resistor according to claim 1, said resistance element being formed in a zig-zag pattern wherein the number of back-and-forth portions thereof per unit length increase in a longitudinal direction.

4. A variable resistor according to claim 1, wherein resistance members are formed within respective turned back portions of said resistance element.

* * * * *